United States Patent [19]

Bock

[11] 4,231,486

[45] Nov. 4, 1980

[54] CONTAINER SEAL AND CLOSURE

[75] Inventor: Erik Bock, Kirke Hyllinge, Denmark

[73] Assignee: Superfos Emballage, Vipperod, Denmark

[21] Appl. No.: 49,794

[22] Filed: Jun. 18, 1979

[30] Foreign Application Priority Data

Jun. 23, 1978 [DK] Denmark ..... 2842/78

[51] Int. Cl.[3] ..... B65D 41/32

[52] U.S. Cl. ..... 220/266; 220/307; 215/250; 215/355

[58] Field of Search ..... 220/307, 266; 215/250, 215/355

[56] References Cited

U.S. PATENT DOCUMENTS 3,998,354 12/1976 Song ..... 220/307 X

*Primary Examiner*—George T. Hall

*Attorney, Agent, or Firm*—Bucknam and Archer

[57] ABSTRACT

The inventive container seal comprises a cover (4) and a rim ring (3) die cast as a unit. In said unit the cover (4) and the rim ring (3) are mutually connected by a radial ring rib (10), said ring rib forming an area of fracture, which is ruptured when the cover is pressed down into the rim ring. At the same time or later the rim ring (3) can be pressed into the mouth (2) of a container. The rim ring (3) is reinforcing the container wall so that an outer stiffening bead is superfluous.

2 Claims, 6 Drawing Figures

CONTAINER SEAL AND CLOSURE

Figure 1:
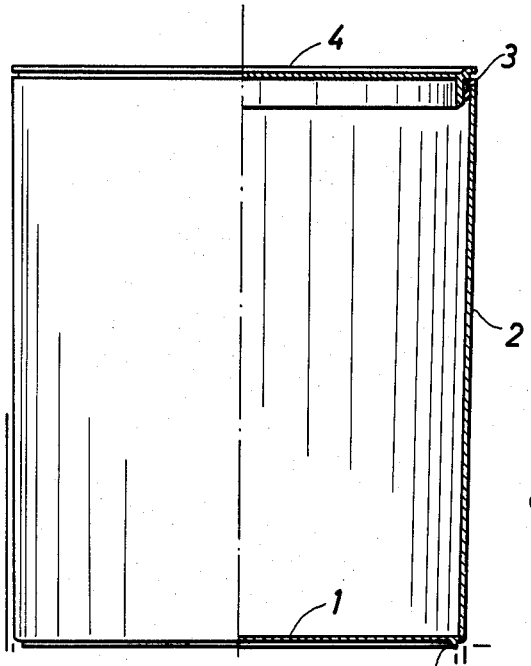

The invention relates to a container seal comprising a cover for fitting in a rim ring engaging the mouth of a container, said cover being formed integral with the rim ring in such a manner that the two portions may be separated in an area of fracture.

German patent specification No. 1,270,483 discloses the principle of forming the cover integral with the rim ring. The publication deals with a seal which is particularly shaped for tight sealing of a container, the contents of which are subjected to a superatmospheric or a low pressure. This known seal comprises an outer tubular portion forming the rim ring and an inner tubular portion connected at the top to the outer tubular portion and simultaneously separated from said outer portion by a narrow slot. When the seal is positioned on the container, a proofing is formed by the tubular portions being pressed so tightly together that the slot is closed in a circular area. The area of fracture between the tubular portions is situated at the rim surface turning upwards on the outer tubular portion, and the portions are not separated until a tear-off corner situated on the circumference of the cover is pulled off when the container for the first time is to be opened. It is true that the container seal according to the invention is manufactured by forming the cover integral with the rim ring, but it is not especially constructed for sealing against an inner superatmospheric or low pressure, and from a purely constructive point of view it is distinguished from the aforesaid known seal. Furthermore, the main purpose of the seal according to the invention is to use it for sealing pots for paint and similar liquids.

Today die cast plastic containers are extensively used as packing for paint and other liquids. The rim of the known pots is stiffened with an outer bead portion simultaneously serving as a sealing means co-operating with an axial, circumferential flange on the container cover overlapping the bead. However, in many cases it is preferred to avoid manufacturing of die cast pots with an outer bead and an overlapping cover flange. This is for instance the case when the previously, extensively used cylindrical pots of sheet material are desired to be replaced by plastic pots while maintaining the usual filling and packing lines previously used for cans made of sheet metal. The replacement of cans of sheet metal by plastic pots is especially topical within the paint industry, where a steadily increasing part of paint for home use is sold as plastic paint. Such plastic paint is best kept in plastic containers since the cans of sheet metal used today rust. Die casting of a pot comprising a stiffening bead turning inwards is, however, only possible when a mould having a core portion is used. This core portion must be sufficiently foldable to be removed from the pot opening surrounded by the stiffening bead. Such a core is, however, complicated and very sore.

It is true that it is possible by the blast method to manufacture pots having a stiffening bead turning inwards at the uppermost rim, but this method does not permit achievement of the piling capacity and sealing of the container desired for instance for pots for paint.

The object of the invention is to provide a container seal of the above type, which in a simple manner permits manufacture of a plastic pot possessing the above properties.

The seal according to the invention is characterized in that the area of fracture is a ring rib projecting radially between the lowest edge portion of an axial flange on the cover and the uppermost end of the rim ring.

Such a container seal permits finishing of a container having a substantially smooth inner wall and without an outer bead, since the connection between the cover and the rim ring is interrupted by pressing down the cover into the rim ring, preferably at the same time as the rim ring is pressed down into the container. This procedure may, if desired, be performed after filling of the pot with paint or another liquid so that both a packing and a finishing of the container are simultaneously performed. Nothing, however, prevents the unit comprising a cover and a rim ring from being manufactured in a particular factory department and the container in another department. Furthermore, the finishing and the separation of the cover and the rim ring may be performed in a different manner than the aforesaid. When the cover is pressed down into the rim ring, the ring rib forms a projecting catch rib at the previous area of fracture, said rib snatching into a circular locking surface on the rim ring.

The rim ring may be secured to the container mouth in various manners, e.g. by a tight fitting, gluing or welding, but according to a preferred embodiment of the container seal according to the invention said rim ring comprises a circumferential outer rib capable of snatching into a locking groove in the inside of the container mouth, a supporting edge turning downwards and capable of abutting the rim of the container mouth, and a bearing edge turning upwards and capable of supporting an edge portion of the cover when said cover is put on. The ring may be easily cast in this shape, and additional measures for preventing the ring from sliding into the container are superfluous. Furthermore, this ring forms a safe support for the cover.

It is according to the invention preferred that the axial flange of the cover ends in a surface inclining inwards, the uppermost portion of which is formed by the radial ring rib having a barb-shaped cross section. In this manner a centered control of the cover during the mounting, e.g. in a sealing machine, is ensured.

An embodiment of the plastic container according to the invention is characterized in that the axial flange of the cover has a substantially U-shaped cross section, whereby the outer leg of the U extends into the edge portion of the cover, and the radial, inner leg of the U extends into a plane, central cover surface. Such a shaping of the container seal provides an increased flexibility of the cover and thereby an easy mounting and demounting.

Figure 2:
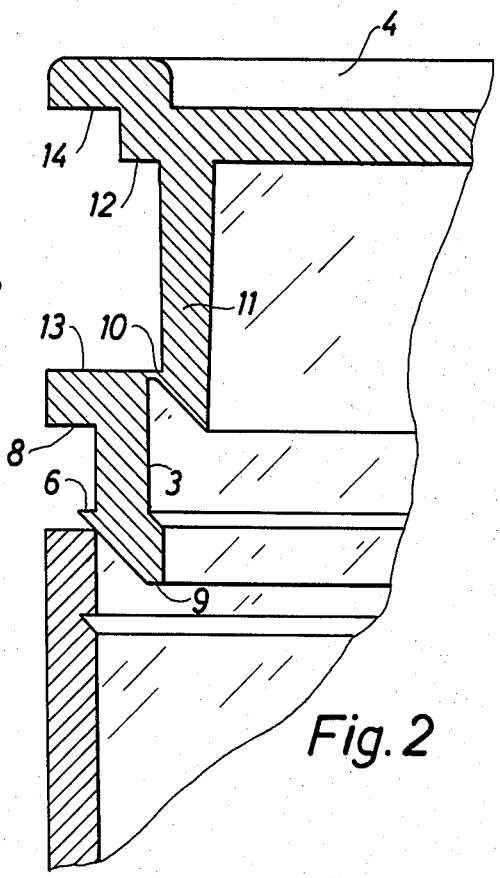
Figure 3:
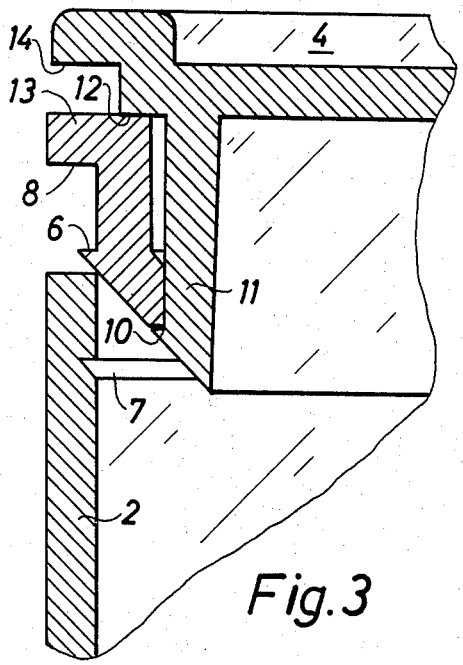
Figure 4:
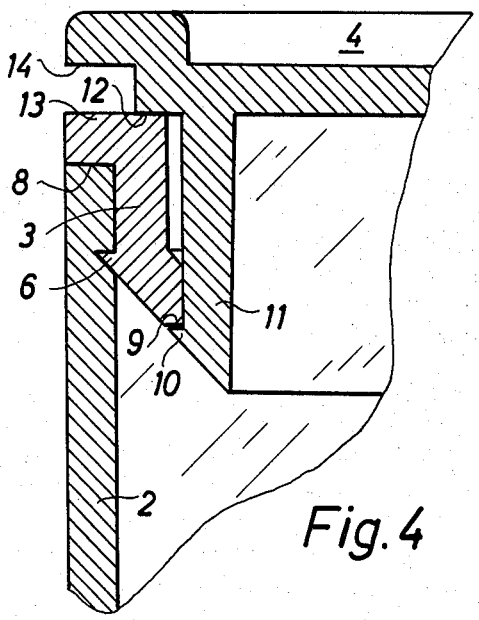
Figure 5:
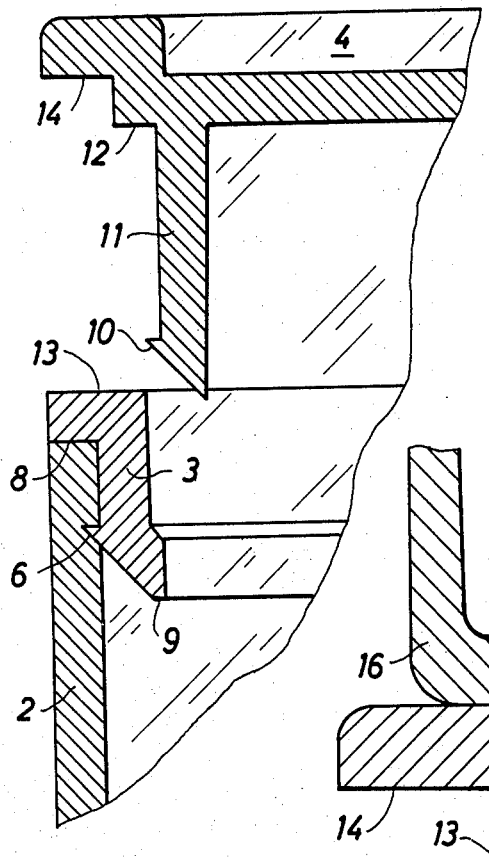
Figure 6:
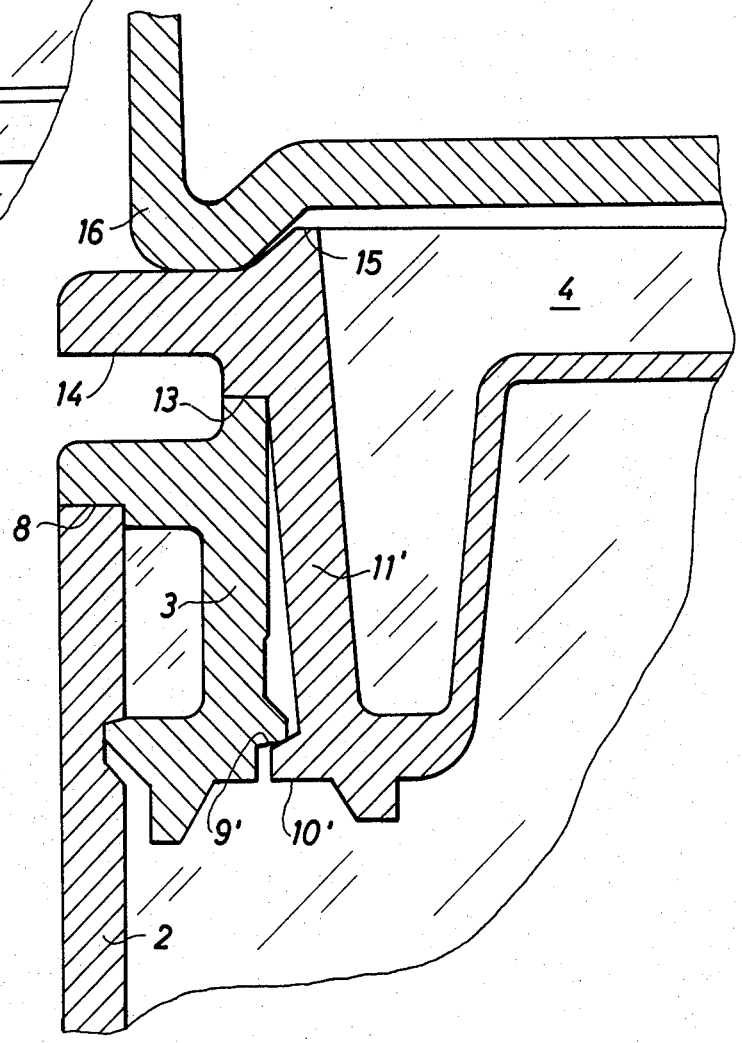

The invention will be described below with reference to the accompanying drawing, in which FIG. 1 illustrates a container seal according to the invention, partly in section, FIGS. 2 to 4 illustrate an embodiment of the seal according to the invention, partly in section, and immediately before, during, and after the mounting on a container with smooth walls, FIG. 5 is a corresponding view partly in section of the cover removed from the container, and FIG. 6 is a view partly in section through a container comprising an alternative embodiment of the seal according to the invention.

The container illustrated in FIG. 1 comprises an independent, die cast container unit with a closed bottom 1 and a smooth, upright wall 2. This upright wall is substantially shaped as an upright, circular cylinder. The container unit furthermore comprises a rim ring 3 pressed into the container mouth at the top for stiffening the uppermost rim 5 of the wall and for supporting a cover 4. The bottom 1 comprises a projecting rim 5 capable of being catched and controlled by a central recess in the cover 4 of the container located beneath in a pile of equal containers.

The shape of the rim ring and the cover of the embodiment illustrated in FIG. 1 appears more detailed from the cross section illustrated in FIG. 4. It appears that the rim ring comprises a circumferential outer rib 6 having a barb-shaped cross section and being catched by a correspondingly shaped locking groove 7 in the inside of the container wall 2. The rim ring abuts a supporting edge 8 turning downwards on the top rim of the container wall 2. At the lowest end, the rim ring 3 forms a locking surface 9 for a barb-shaped catching rib 10 on the outer side of an axial cover flange portion 11. When the cover 4 is positioned on the container, a circumferential rim portion 12 of the cover abuts a radial bearing edge 13 turning upwards on the rim ring. A slot is provided between this bearing edge 13 and a radial flange 14 on the cover, a coin or another object being insertable in said slot when the user is to take off the cover.

FIGS. 2 and 3 illustrate how the container and the cover are manufactured. FIG. 2 illustrates a die cast unit comprising a rim ring 3 and the cover 4, said portions still being mutually connected at the catching rib 10 of the cover. This catching rib 10 is formed during the casting by a very narrow inlet between the portions forming cover and rim ring respectively. After casting of the cover-rim ring unit the cover 4 is pressed into the ring 3 whereby the thin connecting portion between the portions is interrupted, and the catching rib 10 engages the locking surface 9 on the rim ring as illustrated in FIG. 3. Now the cover 4 and the rim ring 3 may be simultaneously pressed into the pot or container 1, 2, i.e. into the position illustrated in FIG. 4, after filling the pot with paint or another liquid. By inserting a screwdriver or a coin into the slot between the bearing edge 13 and the cover flange 14 the cover may be removed whereas the rim ring remains on the container as a stiffening on the container wall (FIG. 5), and the cover may easily be repositioned by being pressed down in vertical direction.

FIG. 6 illustrates an embodiment of the container according to the invention, wherein corresponding portions are referred to by the same reference numerals as the above embodiment. The flange portion of the cover has a U-shaped cross section whereby it is more flexible and easier to remove than the known flange portions. The cover comprises at the top of its flange portion an upright edge 15 controlling a circumferential edge portion 16 on the bottom of a container piled above.

In order to facilitate the pressing down of the rim ring and the cover, they may be pointed downwards as illustrated in the drawing. It is to be understood that both the cover and the rim ring may be formed in many ways within the scope of the invention, and that the container not necessarily need to be a circular cylinder, but may also have for instance a square cross section.

I claim:

1. A seal for a container which comprises at least one upright wall and a cover, which seal comprises a rim ring engaging the mouth of the container, said cover being formed integral with said rim ring, said cover having an axial flange having a lower edge portion, a rib projecting radially between said lower edge portion and the uppermost end of the rim ring, said rib being tearable and being fractured when the cover and the rim ring are pressed into the mouth of the container, said rib engaging with the lowermost surface of the rim ring when the rim ring and the cover are pressed down into the mouth of the container, said wall of the container having an inner groove, the rim ring comprising a circumferential outer rib which engages with said groove, the rim ring having a supporting edge which turns downwards and abuts the rim of the wall and having a bearing edge which turns upwards and supports an edge portion of the cover.

2. A container seal as claimed in claim 1, wherein the axial flange (11') of the cover has a substantially U-shaped cross section, whereby the outer leg of the U extends into the edge portion of the cover, and the radial, inner leg of the U extends into a plane, central cover surface.

* * * * *